United States Patent [19]

Salvo

[11] Patent Number: 4,834,407

[45] Date of Patent: May 30, 1989

[54] PYROTECHNIC DEVICE FOR A SKATEBOARD

[76] Inventor: Stephen K. Salvo, 7817 Harbor Dr., Raleigh, N.C. 27615

[21] Appl. No.: 117,086

[22] Filed: Nov. 5, 1987

[51] Int. Cl.[4] ..... A63C 17/26

[52] U.S. Cl. ..... 280/87.042; 280/11.2; 280/816; 446/22; 446/23

[58] Field of Search ..... 280/11.19, 809, 816, 280/87.04 R, 87.04 A, 11.2; 446/22, 23; 431/253

[56] References Cited

U.S. PATENT DOCUMENTS

| | | | |
|---|---|---|---|
| 1,790,423 | 1/1931 | Hooks | 280/11.19 |
| 3,086,788 | 4/1963 | Vislocky | 280/816 |
| 3,990,713 | 11/1976 | Hokanson | 280/87.04 A |
| 4,040,639 | 8/1977 | Scardenzan | 280/87.04 A |
| 4,286,806 | 9/1981 | Bergstein | 280/816 |
| 4,394,037 | 7/1983 | Kuntz | 446/23 |

*Primary Examiner*—Charles A. Marmor
*Assistant Examiner*—Eric Culbreth
*Attorney, Agent, or Firm*—Rhodes, Coats & Bennett

[57] ABSTRACT

A pyrotechnic device is disclosed which mounts to the underside of a skateboard. When frictionally engaged with an abrasive surface traveled by the skateboard, the pyrotechnic device emits sparks so as to accentuate stunts being performed by the user.

2 Claims, 2 Drawing Sheets

PYROTECHNIC DEVICE FOR A SKATEBOARD

FIELD OF THE INVENTION

This invention relates to pyrotechnic devices for individually propelled land vehicles or skateboards.

BACKGROUND OF THE INVENTION

In its early years, skateboarding meant riding a 2" x 4" x 30" board with wheels salvaged from a discarded roller-skate attached to each end. Modern day skateboards are wider, stronger and come in many colorful designs, shapes and sizes. The popularity of the skateboard is reflected in specialty shops and magazines, videos, and national competitive events requiring highly trained and skilled operators.

The maneuvers performed by the individual operators often require changes in direction or speed. These alterations occur principally by the operator placing the foot used to propel the vehicle on the rear portion of the board causing it to pivot downward thereby frictionally engaging the traveled road surface causing a change in speed or direction. Such an event can be enhanced by special effects created by an attached pyrotechnic device ignited by frictional encounter with the road surface.

SUMMARY AND OBJECTS OF THE INVENTION

The invention is a pyrotechnic device for a skateboard comprising a platform with at least two pairs of wheels connected to the underside thereof. The pyrotechnic device includes a housing structure capable of retaining a plurality of spark emitters. The housing structure is attached to the rear tail portion of the skateboard. When the operator causes the pyrotechnic device to engage an abrasive surface traveled by the vehicle, it produces sparks which emit from the rear of the skateboard.

Accordingly, it is the primary object to provide a pyrotechnic device which will produce a special effect when brought into engagement with the road surface and thereby accentuate stunts and manuevers performed by the skateboard rider.

Another object of the present invention is to provide a pyrotechnic device which will not be expended during a single event, but will repeatedly provide the special effect.

Another object of the present invention is to provide a pyrotechnic device which is not unreasonably dangerous.

Other objects and advantages of the present invention will become apparent and obvious from a study of the following description and the accompanying drawings which are merely illustrative of such invention.

DETAILED DESCRIPTION OF THE INVENTION

Figure 1:
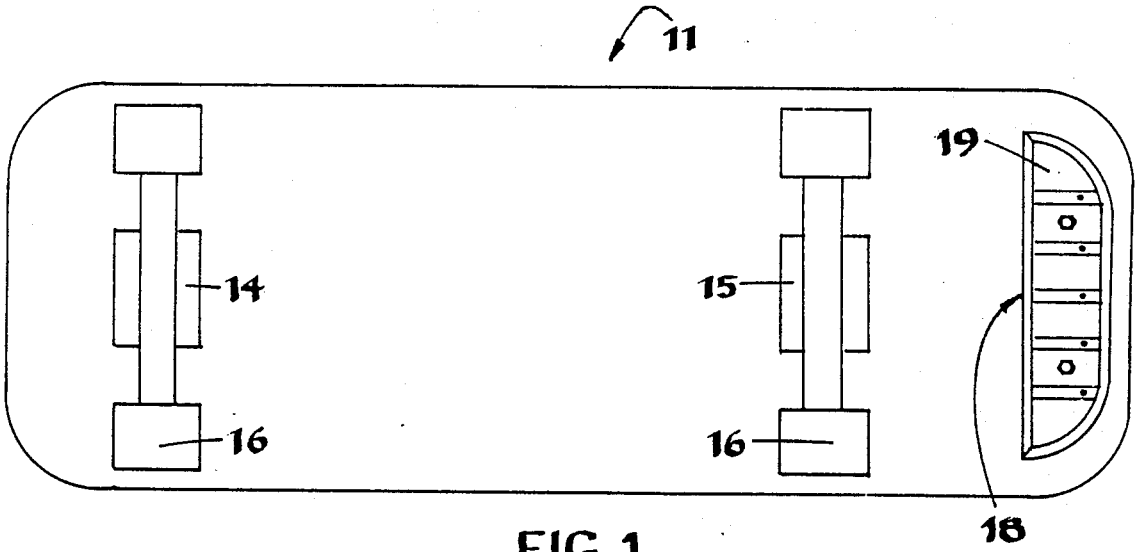
FIG. 1 is a bottom view of skateboard showing the pyrotechnic rear mounted device attached thereto.
Figure 2:
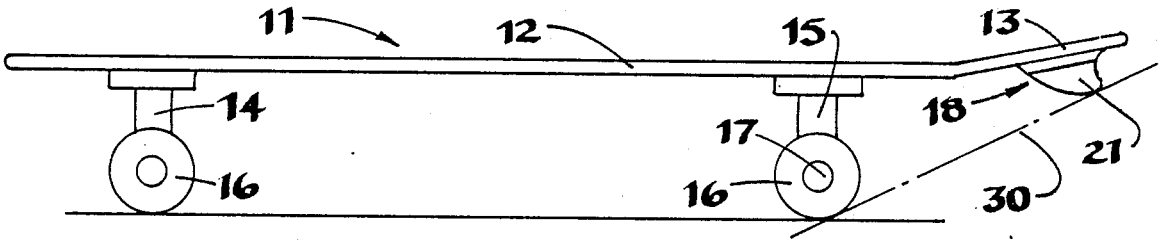
FIG. 2 is a side view of skateboard showing the attached pyrotechnic device.
Figure 3:
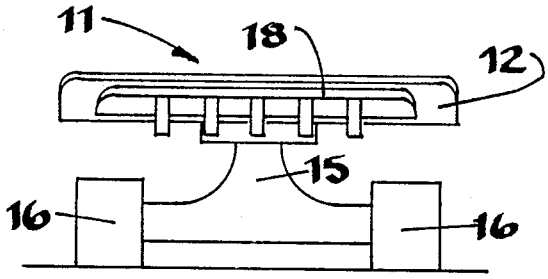
FIG. 3 is a rear view of skateboard showing the attached pyrotechnic device.
Figure 4:
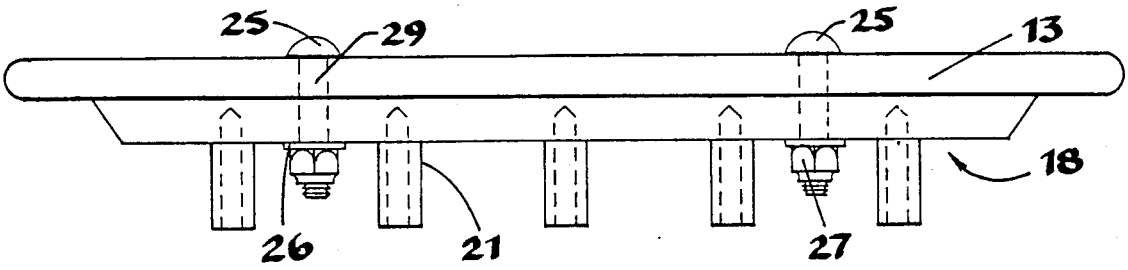
FIG. 4 is a rear view of board portion of skateboard with the pyrotechnic device attached thereto.
Figure 5:
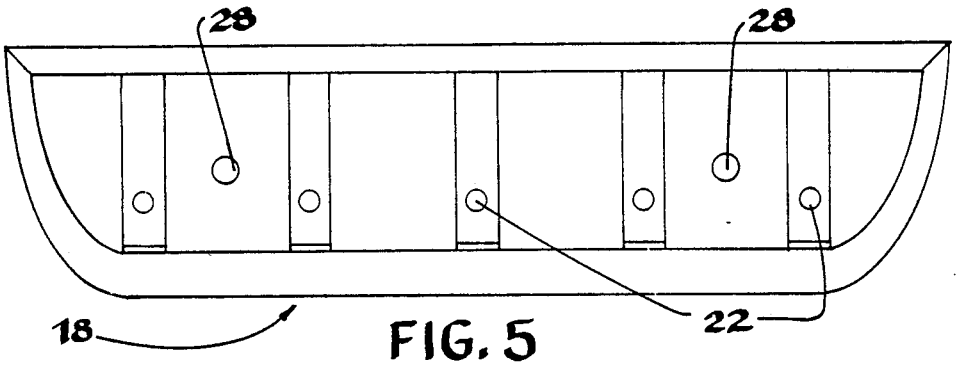
FIG. 5 is a bottom view of the pyrotechnic device.
Figure 6:
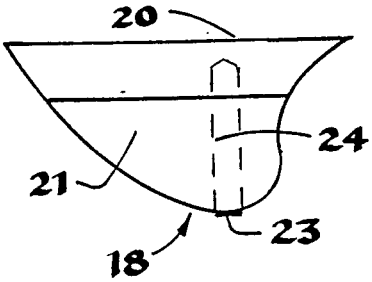
FIG. 6 is a side view of the pyrotechnic device.
Figure 7:
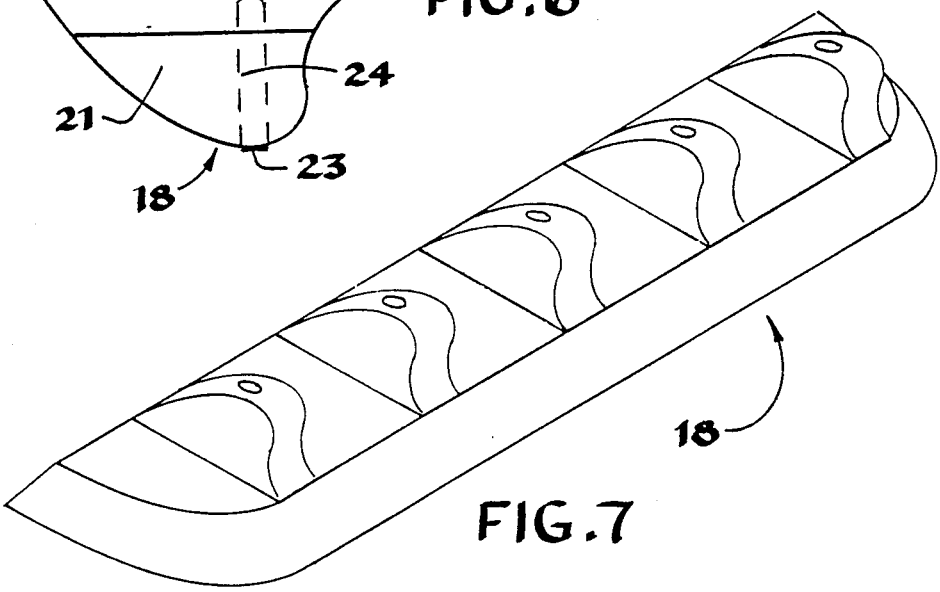
FIG. 7 is an isometric view of the pyrotechnic device.

Referring to the drawings, there is shown a skateboard of conventional construction which is indicated by the numeral 11. The skateboard 11 includes a board member 12 having a raised tail portion 13. Said member is supported by forward and rearward truck assemblies 14 and 15 respectively. Each of the truck assemblies include a pair of wheels 16 which rotate around axles 17.

As seen in the drawings, the pyrotechnic device 18 includes a housing structure comprising a flat base member 19 and a plurality of vertical integral fins 21 evenly spaced on the ground side of said base member 18. The fins 21 each include at least one open-ended port 22 for housing the spark emitters 23. The spark emitters 23 are made from flint or other material which provides a spark when engaged with an abrasive surface. The spark emitters 23 are secured to the port walls 24 by adhesive or any other suitable means so the end of the spark emitters 23 are exposed.

The pyrotechnic device 18 is secured to the underside of the tail portion 13 of board member 12 a pair of bolts 25 which are adapted to pass through openings 28 in base member 20 and openings 29 in the tail portion 13 of board member 12. A washer 26 and nut 27 are then threaded onto the bolt 25 until the nut is set firmly against the board member 12, thus, securing the pyrotechnic device 18 in place. This provides a relatively simple method for replacing the pyrotechnic device 18 once the spark emitters 23 thereby allowing the event to be repeated until said emitters 23 have been consumed.

To use the pyrotechnic device 18, the same is first secured to the skateboard 11 as hereinabove described. When the skateboard is caused to pivot about the rear axle 17 by applying pressure to the tail portion 13 of the skateboard 11, the pyrotechnic device 18 is brought into contact with the vehicle road surface. The exposed ends of the spark emitters 23 housed in the pyrotechnic ports 22 are then frictionally engaged with the road surface. This frictional encounter produces a burst of sparks which accentuate the manuever. The frictional encounter also simultaneously erodes the plastic arcuate fins 21 and the spark emitters 23 have been consumed.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A pyrotechnic device for use in connection with a skateboard adapted to travel over a relatively hard, abrasive surface and including a generally horizontal board member supported by front and rear wheels, the pyrotechnic device comprising:

(a) a housing structure secured to the underside of the board member and including a lower surface adapted to engage the surface traveled by the skateboard when the board member is rotated about the axis of the rear wheel;

(b) a bore formed in the housing structure that extends from the lower surface thereof;

(c) a spark emitter disposed within the bore in the housing structure and having an exposed end lying flush with the lower surface of the housing structure so that the exposed end engages the surfaces traveled by the skateboard essentially simultaneously with the lower surface of the housing structure to produce a burst of sparks when the board is rotated about the axis of the rear wheel, wherein the housing structure is made of a relatively soft material that erodes when brought into engagement with the abrasive surface traveled by the skateboard so that the end of the spark emitter will be continually exposed.

2. The pyrotechnic device according to claim 1 wherein the housing structure includes a base portion for securing said housing structure to the board member, and a plurality of fins extending generally downwardly from the base portion, wherein each of said fins has a said bore formed therein for receiving a spark emitter.

* * * * *